US005511849A

United States Patent [19]

Cahaley et al.

[11] Patent Number: 5,511,849

[45] Date of Patent: Apr. 30, 1996

[54] COLLAPSIBLE CHAIR

[75] Inventors: Steven G. Cahaley, West Chester; James E. Schinski, Malvern, both of Pa.

[73] Assignee: The First National Bank Of West Chester, West Chester, Pa.

[21] Appl. No.: 309,033

[22] Filed: Sep. 20, 1994

[51] Int. Cl.[6] ..... A47C 13/00

[52] U.S. Cl. ..... 297/129; 297/40; 297/183.5; 297/188.01; 297/451.11

[58] Field of Search ..... 297/27–29, 16.1, 297/16.2, 38, 39.40, 35, 46, 129, 183.5, 183.7, 183.1, 118, 188.1, 188.09, 188.08, 188.01, 331, 323, 324, 445, 440.23, 25–26, 56, 59, DIG. 2, 445.1, 449.1, 451.11, 450.1

[56] References Cited

U.S. PATENT DOCUMENTS

| | | | |
|---|---|---|---|
| 246,702 | 9/1881 | Arnold | 297/26 |
| 2,072,075 | 2/1937 | Travers et al. | 297/28 |
| 2,354,845 | 8/1944 | Thornton | 297/DIG. 4 X |
| 2,587,176 | 2/1952 | Larson | 297/35 X |
| 2,675,860 | 4/1954 | Schroeder | 297/183.5 X |
| 2,727,563 | 12/1955 | Cook | 297/24 |
| 3,189,380 | 6/1965 | Reguitti | 297/188.1 X |
| 3,290,089 | 12/1966 | Farrell | 297/188.1 X |
| 4,319,779 | 3/1982 | Leonhart | 297/118 X |
| 4,659,142 | 4/1987 | Kuchinsky, Jr. | 297/118 |
| 4,674,793 | 6/1987 | Kettler | 297/28 |
| 4,678,202 | 7/1987 | Jensen et al. | 297/DIG. 4 X |
| 4,898,421 | 2/1990 | Brunn | 297/35 X |
| 4,934,719 | 6/1990 | duPont | 297/DIG. 4 X |
| 5,149,118 | 9/1992 | Oxford | 297/445 X |
| 5,165,755 | 11/1992 | Rho | 297/56 X |

FOREIGN PATENT DOCUMENTS

| | | | |
|---|---|---|---|
| 610489 | 10/1960 | Italy | 297/39 |

*Primary Examiner*—Milton Nelson, Jr.
*Attorney, Agent, or Firm*—Connolly & Hutz

[57] ABSTRACT

A collapsible chair has an adjustable in-use position and a folded transport position. A seat is supported by opposite pairs of front and rear legs pivoted together at their upper ends. Opposed pairs of outwardly extending front and rear retainer pins on the seat engage front and rear tracks on the legs to support the seat and also to enable the seat and legs to be folded together for transport. A reclinable back rest is hingedly connected to the seat, and arm rests extend between the back rest and the upper ends of the front legs. The connection of the arm rests to the front legs is adjustable which adjusts the inclination of the reclinable back rest. Drum shaped wheels are rotatably mounted to and between the rear legs at their lower ends. The front and rear legs are spread apart at their lower ends when the collapsible chair is in use. Conversely, in the transport position the legs and seat are folded together and the drum shaped wheels engage the ground. The seat may include a separate central portion which swings outwardly and away from the seat to form a cargo transport when the collapsible chair is in its transport position.

16 Claims, 6 Drawing Sheets

COLLAPSIBLE CHAIR

BACKGROUND OF THE INVENTION

The present invention relates to a collapsible chair, and more particularly to a collapsible chair construction which is easily converted from in-use and to transport positions and vice versa.

Prior to the present invention numerous chair configurations have been proposed having a variety of in-use and transport positions. However, many of these chairs are difficult to transport, particularly over certain terrains such as beach sand, for example. Moreover, when these chairs are transported they usually comprise just one of a large number of items to be transported to a desired distant site. The heretofore chair constructions lack many of the readily apparent features of the present invention described below in detail.

SUMMARY OF THE INVENTION

Accordingly, it is an object of the present invention to provide a versatile collapsible chair having an adjustable in-use position and a folded transport position which facilitates ease of transport use over many terrains.

Another object of the present invention is the provision of a versatile collapsible chair having a folded transport position with a cargo transport that facilitates the moving of other items.

In accordance with the present invention, a collapsible chair has an adjustable in-use position and a folded transport position. The chair includes a seat having an ergonomic upper surface and opposite side surfaces. Pairs of front and rear legs are located on opposite sides of the seat, and each pair of legs is connected together by a leg connector pivot pin at the upper ends of the legs. The seat has opposed pairs of front and rear retainer pins on its sides that engage and cooperate with front and rear tracks on the inside surfaces of the legs to support the seat and also to enable the seat and legs to be folded together for transport. A reclinable back rest has an ergonomic back surface and a lower end hingedly connected to the seat. A pair of opposed arm rests extend between the back rest and the upper ends of the front legs. The connection of the arm rests to the front legs is adjustable which enables the inclination of the back rest to be adjusted. Drum shaped wheels are rotatably mounted to and between the rear legs at the lower ends thereof for ease of transport when the collapsible chair is in its transport position.

Preferably the seat includes a separate central portion hingedly connected to the front of the seat for swinging movement outwardly and away from the seat. Flexible foldable sides are connected between the sides of the seat and the sides of the separate central portion. With the collapsible chair in its folded transport position the separate central seat portion and the flexible foldable sides form a cargo transport when the central portion is swung outwardly about its hinge connection.

In the preferred embodiment, the flexible foldable sides are arranged to limit the swinging movement of the separate central portion to approximately 90° about its hinge connection.

The drum shaped wheels may include a series of transverse slots for increased traction. Also, the drum shaped wheels may comprise a pair of wheels each having a separate axle with one axle and wheel connected at the lower end of one rear leg and the other wheel and axle connected at the lower end of the other rear leg. Separate treads may be attached to each of the drum shaped wheels for even more traction.

The reclinable back rest may include an upper end with a hand hold. Also, a front leg brace may be connected between the lower ends of the front legs and a rear leg brace may be connected between the lower ends of the rear legs.

BRIEF DESCRIPTION OF THE DRAWINGS

Novel features and advantages of the present invention in addition to those mentioned above will become apparent to those persons of ordinary skill in the art from a reading of the following detailed description in conjunction with the accompanying drawings wherein similar reference characters refer to similar parts and in which.

DETAILED DESCRIPTION OF THE INVENTION

Figure 3:
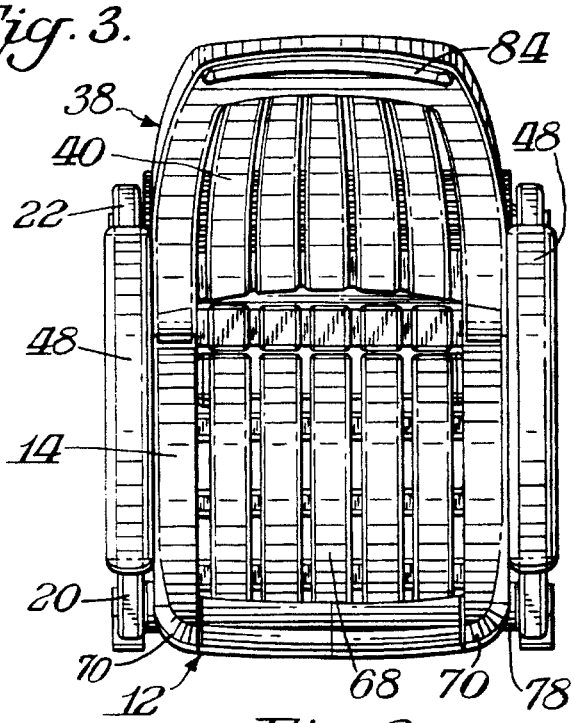
FIG. 3 is a top plan view of the collapsible chair shown in FIGS. 1–3.
Figure 1:
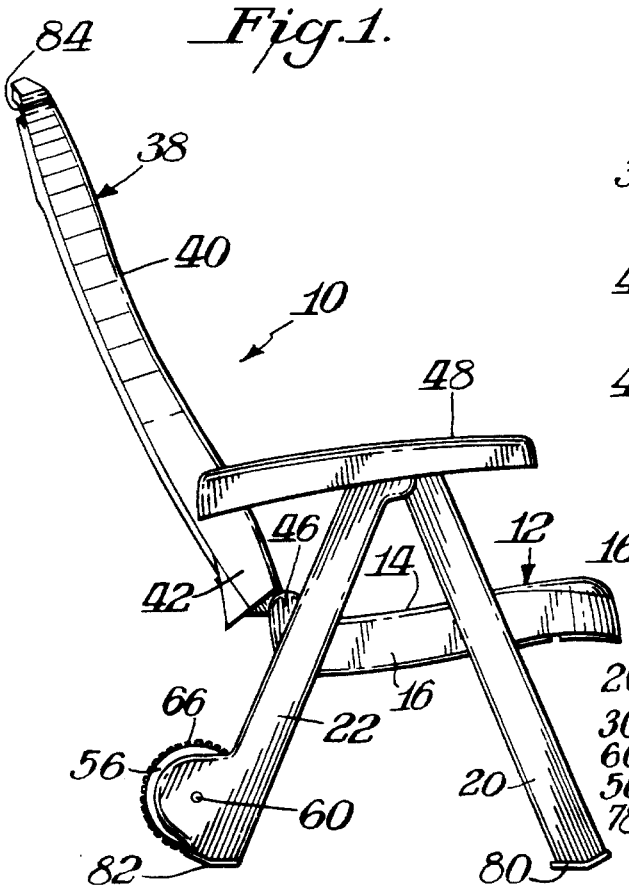
FIG. 1 is a left side elevational view of a collapsible chair in its in-use position, according to the present invention.
Figure 2:
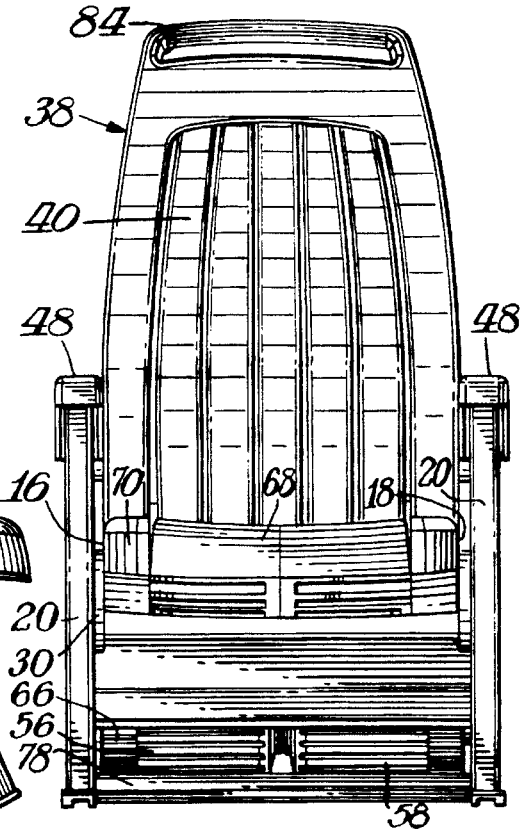
FIG. 2 is a front elevational view of the collapsible chair shown in FIG. 1.
Figure 4:
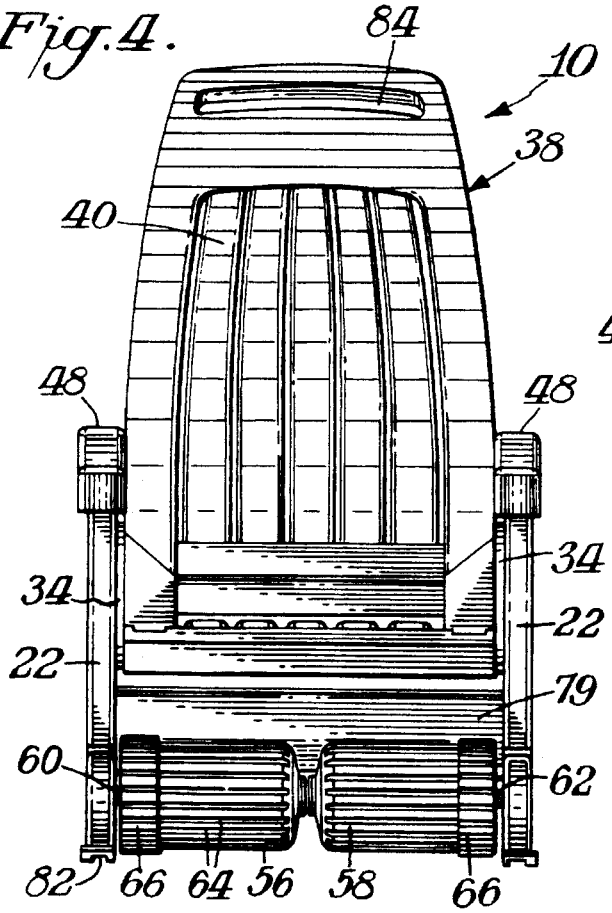
FIG. 4 is a rear elevational view of the collapsible chair shown in FIGS. 1–3.
Figure 6:
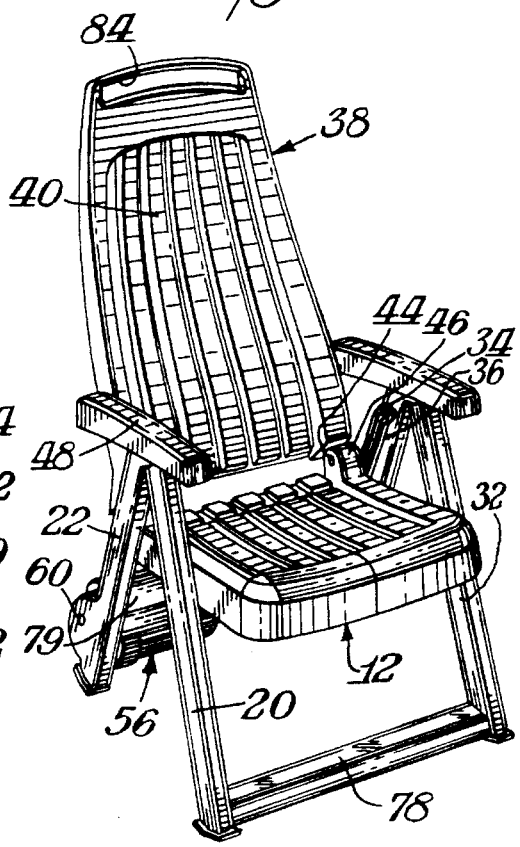
FIG. 6 is an isometric view of the collapsible chair shown in FIGS. 1–5.
Figure 5:
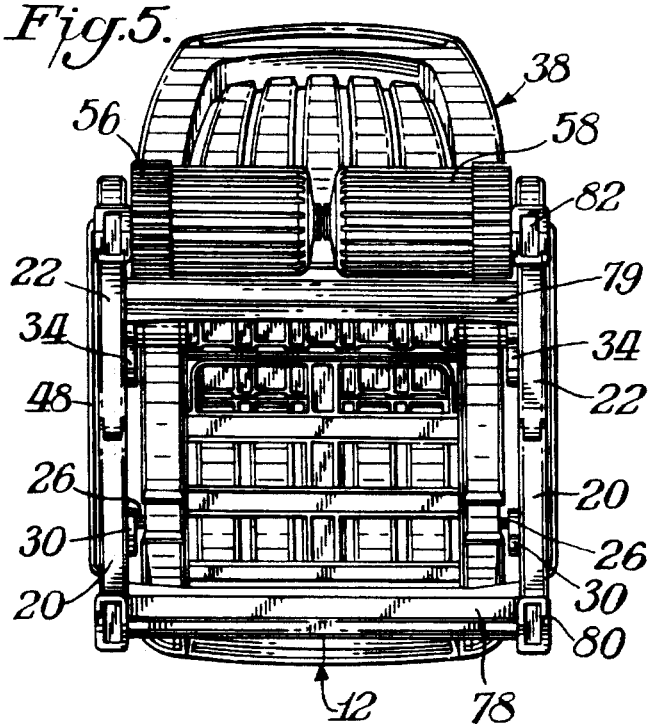
FIG. 5 is a bottom plan view of the collapsible chair shown in FIGS. 1–4.
Figure 8:
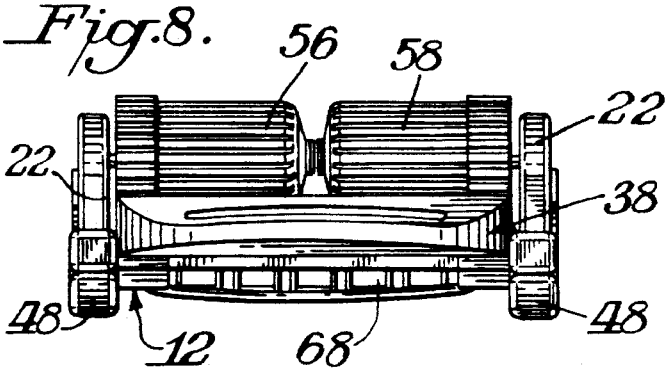
FIG. 8 is a top plan view of the collapsible chair shown in FIG. 7.
Figure 7:
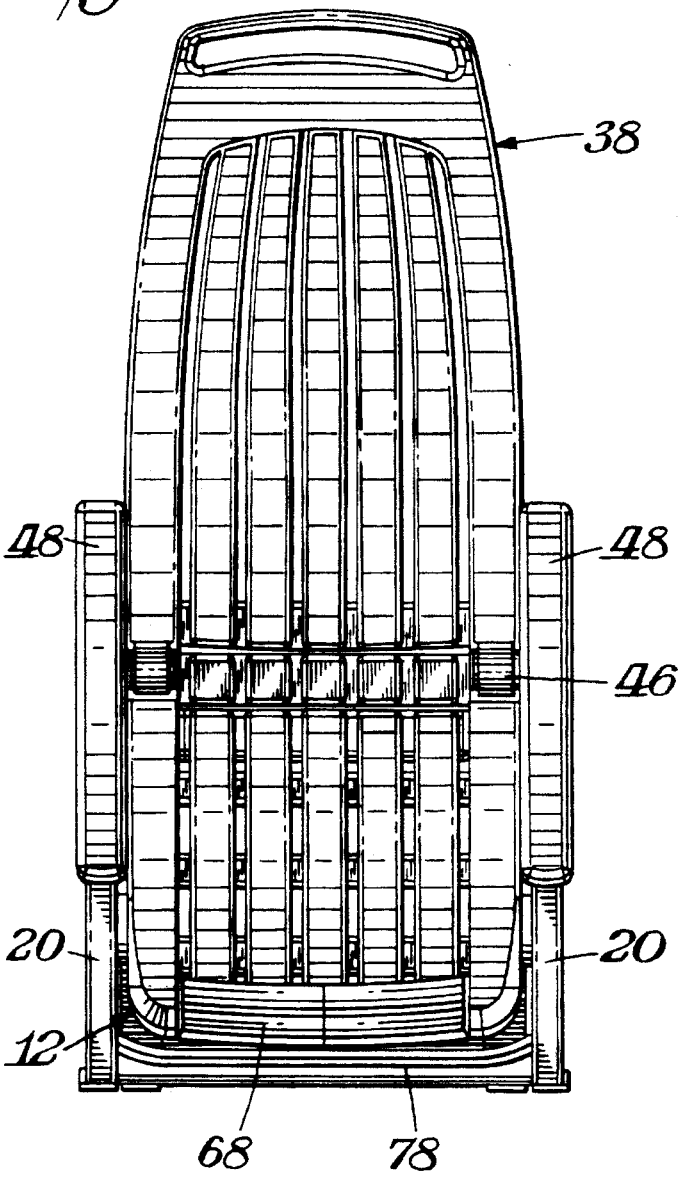
FIG. 7 is a front elevational view of the collapsible chair in its collapsed transport position, according to the present invention.
Figure 9:
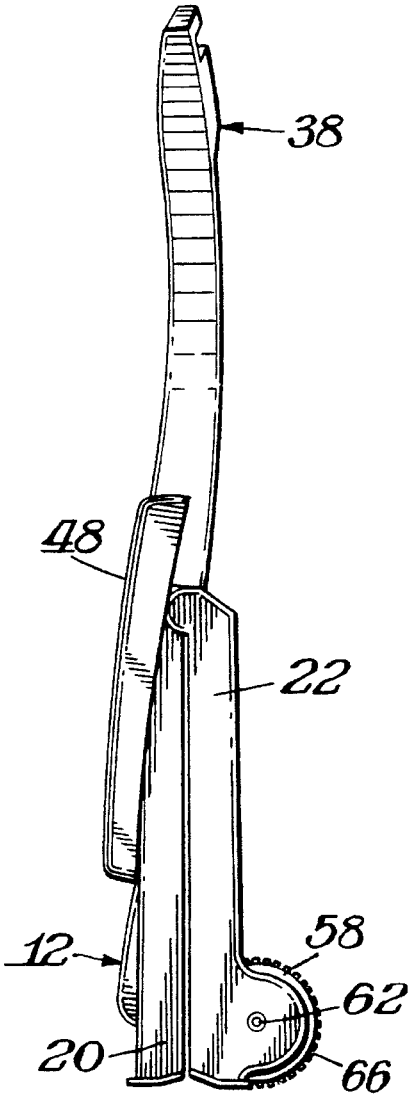
FIG. 9 is a right side elevational view of the collapsible chair shown in FIGS. 7–8.
Figure 10:
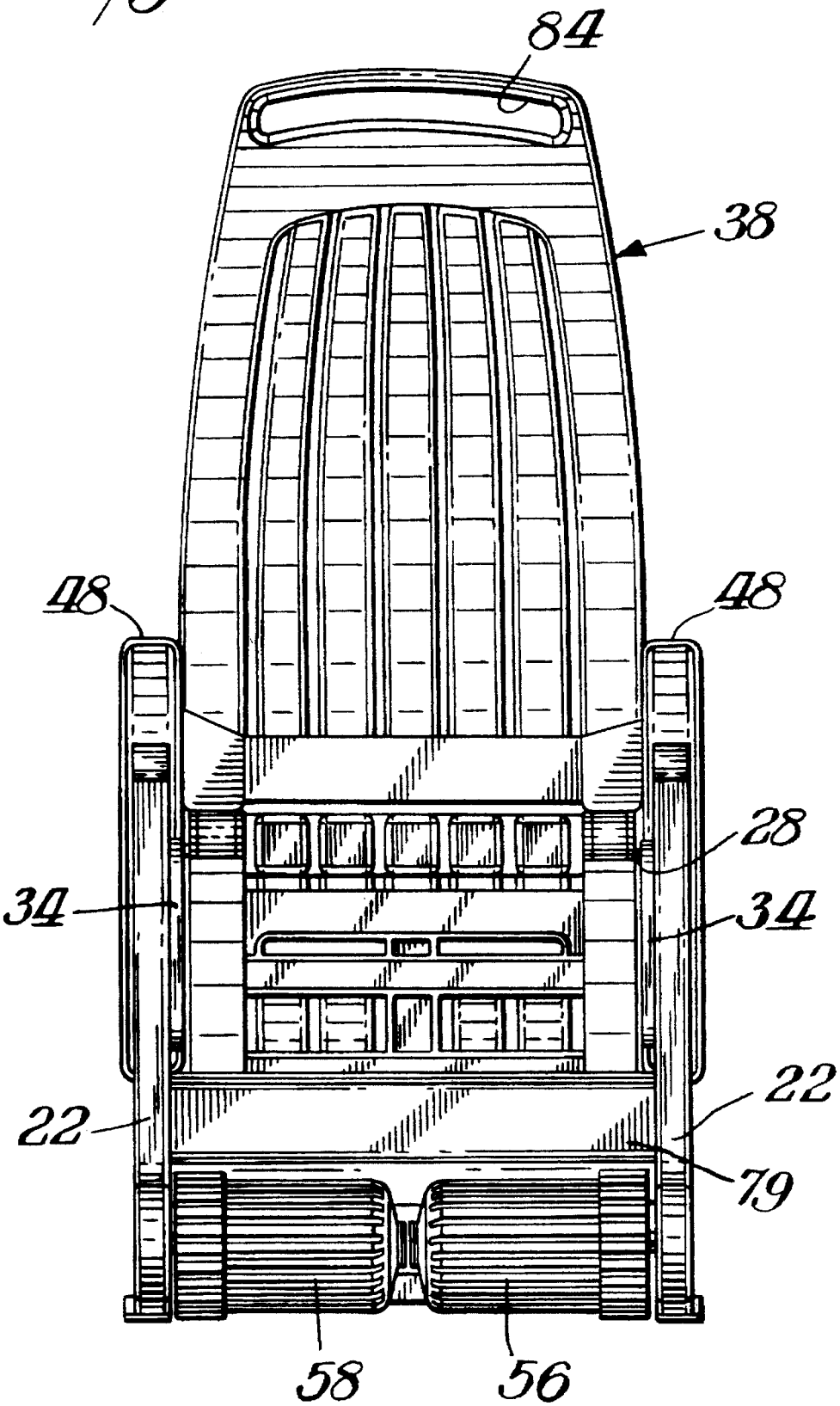
FIG. 10 is a rear elevational view of the collapsible chair shown in FIGS. 7–9.

Referring in more particularity to the drawings, FIGS. 1–6 illustrate a collapsible chair 10 in its in-use position. The chair may be molded of thermoplastic material by techniques well known in the art. The basic components of chair 10 include a seat 12 having an ergonomic upper surface 14 and opposite side surfaces 16, 18. Seat 12 is supported by a pair of front and rear legs, 20 and 22, respectively, with one pair on each opposite side of the seat. The front and rear legs of each pair are connected together at their upper ends by a leg connector pivot pin 24.

Figure 13:
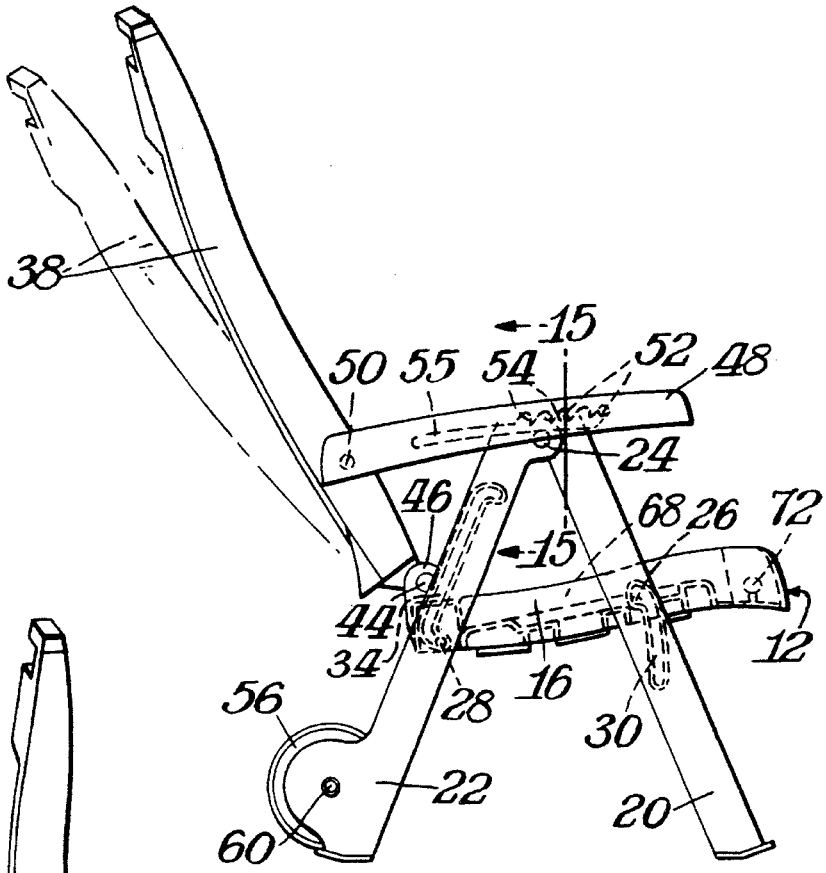
FIG. 13 is a left side elevational view of the collapsible chair illustrating several of its pivot points, according to the present invention.

As shown best in FIG. 13, the connection between seat 12 and the pairs of front and rear legs 20,22 includes an opposed pair of front retainer pins 26 and an opposed pair of rear retainer pins 28, outwardly extending from the opposite side surfaces 16, 18 of seat 12. The front retainer pins engage and cooperate with front tracks 30 formed on an inside surface 32 of front legs 20, and the rear retainer pins engage and cooperate with rear tracks 34 formed on an inside surface 36 of rear legs 22. With chair 10 in its in-use position, the rear retainer pins 28 are located at the lower ends of rear tracks 34. Gravity and the desired seat location so position the rear pins 28 in the rear tracks 34. Similarly, with chair 10 in its in-use position, the front retainer pins 26 are located at the upper end of front tracks 30. Spreading apart of the front and rear legs about leg connector pivot 24 and the contour of front track 30 so position the front pins 26 in the front tracks 30.

Chair 10 also includes a reclinable back rest 38 having an ergonomic back surface 40 and a lower end portion 42 hingedly connected to seat 12 by horizontally disposed back pivot pins 44 that extend through raised seat bosses 46 on opposite sides of the seat at the rear thereof. Back rest 38 is free to pivot about pins 44 to adjust the inclination of the back rest to one of several positions, as explained more fully below. Also, when chair 10 is in the transport position, back rest 38 is also capable of rotation about pivot pins 44 to a folded condition against the rear legs 22 to thereby form a compact package for storage purposes.

Figure 15:
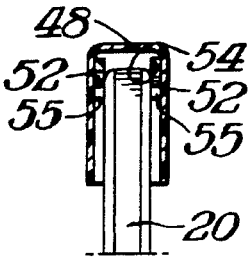
FIG. 15 is a fragmental cross-sectional view taken along lines 15—15 of FIG. 13 illustrating the back rest reclining adjustment mechanism.

Chair 10 further includes a pair of arm rests 48 each having a rear end pivotally connected to the back rest by a pivot pin 50. Each arm rest 48 at its mid to front portion is adjustably connected to an arm retainer pin 52 outwardly extending from the upper end of each front leg 20. These pins engage and cooperate with a series of upwardly extending slots 54 on the inside of each arm rest, as best shown in FIGS. 13 and 15. As shown in phantom outline FIG. 13, positioning arm retainer pin 52 in the forwardmost slot of the series 54 produces the most inclined position of the back rest. Conversely, positioning the arm retainer pin 52 in the most rearward slot of the series produces the most upright position of the back rest. Collectively, the arm retainer pins 52 and the series of slots 54 on each arm rest form a back rest reclining adjustment mechanism. The series of slots 54 are associated with an arm track 55 along which arm retainer pin 52 moves when the chair is converted between in-use and transport modes, as explained more fully below.

Drum shaped wheels 56, 58 are rotatably mounted to and extend between the rear legs 22 at the lower ends thereof. Each drum shaped wheel is closed at its opposite ends. In the preferred embodiment, wheel 56 is connected to one of the rear legs 22 by a separate axle 60 while the other wheel 58 is connected to the other rear leg by its separate axle 62. Each drum shaped wheel has a diameter of 4 to 8 inches, preferably about 6 inches. Also, each wheel has a series of transverse slots 64 arranged on the outside surface thereof to provide greater traction. Additionally, a partial tread 66 may be provided on each drum shaped wheel for ease of transport over gravel and sand as well as smooth ground surfaces.

Figure 11:
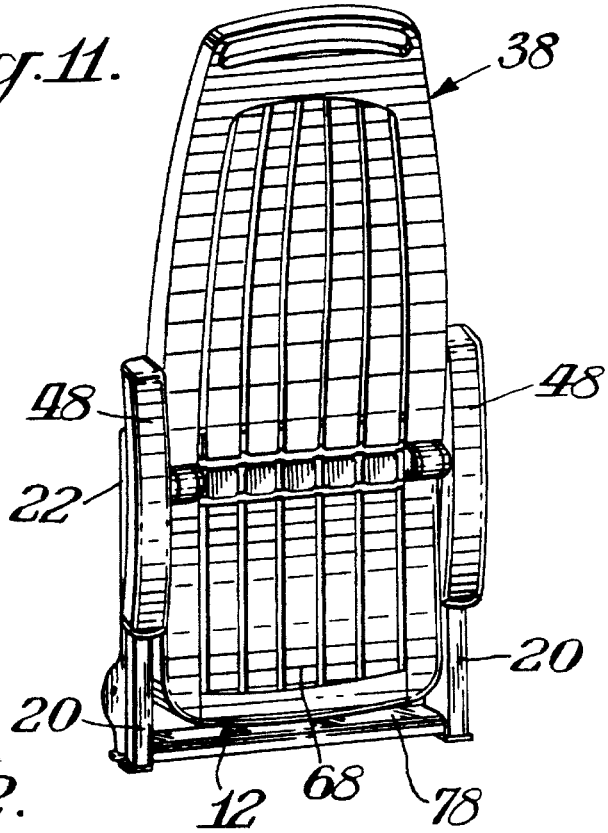
FIG. 11 is an isometric view of the collapsible chair shown in FIGS. 7–10.
Figure 12:
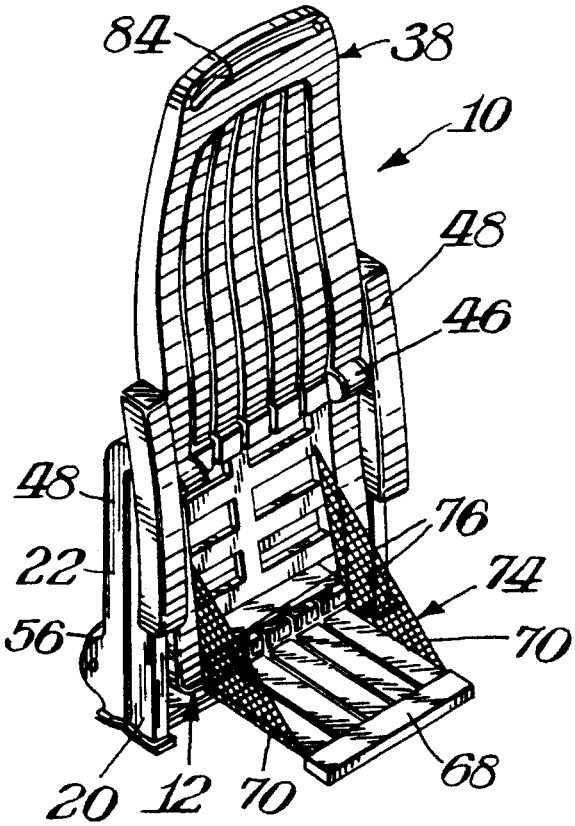
FIG. 12 is an isometric view of the collapsible chair in its collapsed transport position with the central portion of the seat folded down to form a cargo transport, according to the present invention.

As shown best in FIGS. 11–13, seat 12 includes a separate central portion 68 with opposite sides 70 and a hinge connection 72 to the forward part of the seat. The hinge connection is in the form of a horizontally disposed pivot pin which extends through the forward part of the seat and the forward part of the separate central portion 68. This construction and arrangement allows the separate central portion to swing outwardly and away from the seat proper about the hinge connection 72 to form a cargo transport 74 particularly when the collapsible chair is in its transport mode. As explained more fully below, when chair 10 is in its folded transport position, the front and rear legs 20, 22 are swung to each other about leg pivot 24, and seat 12 is folded down about the front and rear retainer pins 26, 28 and front and rear leg tracks 30, 34.

Cargo transport 74 also includes flexible foldable sides 76, such as netting, connected between the seat and the opposite sides 70 of the separate central seat portion. Sides 76 not only contain items placed within the cargo transport but the sides also limit the swing or rotation of central seat portion 68 to approximately 90° about the hinge connection 72. Alternatively, appropriate stop structure may be built into the hinge connection to limit the movement of the central seat portion 68 relative to the seat proper in the formation of the cargo transport.

The seat and back rest are formed with appropriate bracing, U-shaped cross-sections and contours for strength purposes. Also, a front leg brace 78 is connected to and extends between the front legs 20 at the lower ends thereof. As a result of this front leg brace and the connection between the front seat retainer pins 26 and front leg tracks 30, both front legs move as a unit when they swing about the leg pivots 24. Similarly, the rear legs 22 move as a unit as a result of a rear leg brace 79 connected to and extending between the rear legs 22.

When the collapsible chair 10 is in its in-use position as illustrated in FIGS. 1–6, leg pads 80 on the front legs 20 and leg pads 82 on the rear legs 22 engage the ground surface. On hard ground surfaces the drum shaped wheels are slightly elevated out of contact with the ground. However, when the chair is used on beach sand or similar terrains, the front leg brace 78 and the drum shaped wheels 56, 58 may also assist in supporting the chair. The inclination of back rest 38 is easily adjusted to a desired position utilizing the back rest reclining adjustment mechanism comprising the arm retainer pins 52 on the front legs 20 and the series of slots 54 on each arm rest 48.

Figure 14:
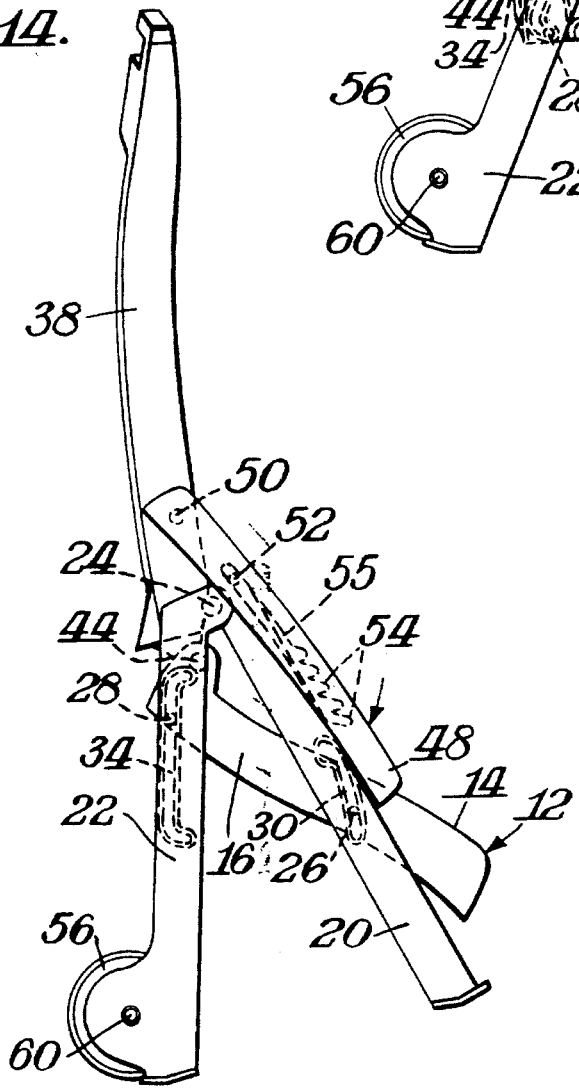
FIG. 14 is a left side elevational view of the collapsible chair similar to FIG. 13 but showing the chair partially collapsed about its pivot points.

When the collapsible chair 10 is converted to its transport mode, the front and rear legs 20, 22 are moved together about the leg pivots 24. Simultaneous with such movements seat 12 is folded down about the connections between the front retainer pins 26 and front tracks 30 and the rear retainer pins 28 and rear tracks 34. These movements are shown in FIG. 14. The front retainer pin moves in a downward direction in front track 34, the rear retainer pin moves in an upward direction in rear track 34, and arm retainer pin 52 shifts in a rearward direction along arm track 55. Ultimately chair 10 is positioned in its transport mode, as shown in FIGS. 7–10. A hand hold 84 at the upper end of back rest 38 enables the chair to be pulled or pushed with the drum shaped wheels in ground engaging contact.

When use of cargo transport 74 is desired, the separate central portion 68 is outwardly rotated about hinge connection 72. Items to be transported are simply loaded onto the cargo transport. Smaller items are confined by the flexible foldable sides 76.

We claim:

1. A collapsible chair having an adjustable in-use position and a folded transport position comprising a seat having an ergonomic upper surface and opposite side surfaces, a pair of front and rear legs on each opposite side of the seat, the front and rear legs of each pair having lower ground engaging ends and upper ends connected to one another by a leg connector pivot pin, the seat also having an opposed pair of front retainer pins and an opposed pair of rear retainer pins outwardly extending from the opposite side surfaces thereof, an elongate front track on the inside surface of each front leg constructed and arranged to receive the opposed pair of front retainer pins and an elongate rear track on the inside surface of each rear leg constructed and arranged to receive the opposed pair of rear retainer pins, a reclinable back rest having an ergonomic back surface and a lower end hingedly connected to the seat, a pair of opposed arm rests each having a rear end pivotally connected to the reclinable back rest, a back rest reclining adjustment mechanism including a retainer pin outwardly extending from the upper end of each front leg and a series of retainer pin receiving slots formed on the inside of each arm rest, and drum shaped wheel means rotatably mounted to and extending between the rear legs at the lower ends thereof whereby the collapsible chair has an in-use position with the front and rear legs spread apart at the lower ends thereof and a folded transport position with the front and rear legs together, the seat folded down about the front and rear retainer pins and the front and rear leg tracks, and the drum shaped wheel means engaging the ground.

2. A collapsible chair as in claim 1 wherein the drum shaped wheel means includes a series of transverse slots for increased traction.

3. A collapsible chair as in claim 1 wherein the reclinable back rest includes an upper end with a hand hold.

4. A collapsible chair as in claim 1 including a front leg brace connected to and extending between the front legs at the ends thereof.

5. A collapsible chair as in claim 1 including a rear leg brace connected to and extending between the rear legs at the ends thereof.

6. A collapsible chair as in claim 1 wherein the drum shaped wheel means includes a pair of drum shaped wheels each having a separate axle with one axle and wheel connected at the lower end of one rear leg and the other wheel and axle connected at the lower end of the other rear leg.

7. A collapsible chair as in claim 6 including separate tread means attached to each of the drum shaped wheels.

8. A collapsible chair having an adjustable in-use position and a folded transport position comprising a seat having an ergonomic upper surface and opposite side surfaces, a pair of front and rear legs on each opposite side of the seat, the front and rear legs of each pair having lower ground engaging ends and upper ends connected to one another by a leg connector pivot pin, the seat also having an opposed pair of front retainer pins and an opposed pair of rear retainer pins outwardly extending from the opposite side surfaces thereof, a front track on the inside surface of each front leg constructed and arranged to receive the opposed pair of front retainer pins and a rear track on the inside surface of each rear leg constructed and arranged to receive the opposed pair of rear retainer pins, a reclinable back rest having an ergonomic back surface and a lower end hingedly connected to the seat, a pair of opposed arm rests each having a rear end pivotally connected to the reclinable back rest, a back rest reclining adjustment mechanism including a retainer pin outwardly extending from the upper end of each front leg and a series of retainer pin receiving slots formed on the inside of each arm rest, and drum shaped wheel means rotatably mounted to and extending between the rear legs at the lower ends thereof whereby the collapsible chair has an in-use position with the front and rear legs spread apart at the lower ends thereof and a folded transport position with the front and rear legs together, the seat folded down about the front and rear retainer pins and the front and rear leg tracks, and the drum shaped wheel means engaging the ground and wherein the seat includes a separate central portion with opposite sides, hinge means at the front of the seat connecting the separate central portion for swinging movement outwardly and away from the seat about the hinge means, and flexible foldable sides connected between the seat sides and the sides of the separate central portion thereof whereby with the collapsible chair in its folded transport position the separate central portion of the seat and the flexible foldable sides form a cargo transport when the central portion is swung outwardly about the hinge means.

9. A collapsible chair as in claim 8 wherein the flexible foldable sides are constructed and arranged to limit the swinging movement of the separate central portion to approximately 90° about the hinge means.

10. A collapsible chair as in claim 8 wherein the drum shaped wheel means includes a series of transverse slots for increased traction.

11. A collapsible chair as in claim 8 wherein the reclinable back rest includes an upper end with a hand hold.

12. A collapsible chair as in claim 8 including a front leg brace connected to and extending between the front legs at the ends thereof.

13. A collapsible chair as in claim 8 including a rear leg brace connected to and extending between the rear legs at the ends thereof.

14. A collapsible chair as in claim 8 wherein the drum shaped wheel means includes a pair of drum shaped wheels each having a separate axle with one axle and wheel connected at the lower end of one rear leg and the other wheel and axle connected at the lower end of the other rear leg.

15. A collapsible chair as in claim 14 including separate tread means attached to each of the drum shaped wheels.

16. A collapsible chair having an adjustable in-use position and a folded transport position comprising a seat having an ergonomic upper surface and opposite side surfaces, a pair of front and rear legs on each opposite side of the seat, the front and rear legs of each pair having lower ground engaging ends and upper ends connected to one another by a leg connector pivot pin, the seat also having an opposed pair of front retained pins connected to the front legs and an opposed pair of rear retainer pins connected to the rear legs, a reclinable back rest having an ergonomic back surface and a lower end hingedly connected to the seat, a pair of opposed arm rests each having a rear end pivotally connected to the reclinable back rest, a back rest reclining adjustment mechanism including a retainer pin outwardly extending from the upper end of each front leg and a series of retainer pin receiving slots formed on the inside of each arm rest, drum shaped wheel means rotatably mounted to and extending between the rear legs at the lower ends thereof, and wherein the seat includes a separate central portion with opposite sides, hinge means at the front of the seat connecting the separate central portion for swinging movement outwardly and away from the seat about the hinge means, and flexible foldable sides connected between the seat sides and the sides of the separate central portion thereof whereby with the collapsible chair in its folded transport position the separate central portion of the seat and the flexible foldable sides form a cargo transport when the central portion is swung outwardly about the hinge means.

* * * * *